US007234372B2

(12) United States Patent
Hu

(10) Patent No.: US 7,234,372 B2
(45) Date of Patent: Jun. 26, 2007

(54) REVERSIBLE RATCHETING TOOL WITH A SMALLER HEAD AND IMPROVED DRIVING TORQUE

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 511 days.

(21) Appl. No.: 10/219,135

(22) Filed: Aug. 15, 2002

(65) Prior Publication Data

US 2002/0194950 A1 Dec. 26, 2002

Related U.S. Application Data

(62) Division of application No. 09/523,625, filed on Mar. 13, 2000, now Pat. No. 6,457,387.

(30) Foreign Application Priority Data

Jan. 11, 2000 (TW) ..... 89200570 U

(51) Int. Cl.
*B25B 13/46* (2006.01)
*G05G 1/00* (2006.01)
*G05G 3/00* (2006.01)

(52) U.S. Cl. ..... 74/577 M; 81/63.2; 81/63.1; 81/62; 81/61; 74/575; 74/577 R; 74/578

(58) Field of Classification Search ..... 74/575, 74/578, 577, 577 M, 577 R; 192/43–43.2; 81/60–63, 63.1, 63.2
See application file for complete search history.

(56) References Cited

U.S. PATENT DOCUMENTS 15,482 A 8/1856 Gilman ..... 81/63
726,012 A 4/1903 Andrew
810,599 A 1/1906 Ansorge
841,686 A 1/1907 Hatfield
878,657 A 2/1908 Munch
893,097 A 7/1908 Reams
915,446 A 3/1909 Kearnes (Continued)

FOREIGN PATENT DOCUMENTS

CN 130638 12/1977

(Continued)

OTHER PUBLICATIONS

First Office Action on Patent Application No. 00103289.5 in People's Republic of China and Translation; (4 p.).

(Continued)

*Primary Examiner*—Vinh T. Luong
(74) *Attorney, Agent, or Firm*—Conley Rose, P.C.

(57) ABSTRACT

A ratcheting tool includes a handle and a head with a compartment. A drive member includes a first end extended beyond the compartment, a second end extended beyond the compartment, and a gear wheel formed between the first end and the second end. The gear wheel is rotatably mounted in the compartment and includes a toothed outer periphery. A pawl is mounted in the compartment and includes a toothed side facing the gear wheel teeth. The toothed side of the pawl includes a first teeth portion having a first center of curvature and a second teeth portion having a second center of curvature located at a position different from the first center of curvature.

47 Claims, 13 Drawing Sheets

U.S. PATENT DOCUMENTS

| | | | | |
|---|---|---|---|---|
| RE13,205 | E | 2/1911 | Lane | |
| 1,033,358 | A | 7/1912 | Turner | |
| 1,078,059 | A | 11/1913 | Mossberg | |
| 1,090,578 | A | 3/1914 | Smythe | |
| 1,194,471 | A | 8/1916 | Boosinger | |
| 1,261,092 | A | 4/1918 | Allen | |
| 1,382,492 | A | 6/1921 | Evans | 81/63 |
| 1,426,127 | A | 8/1922 | Tuttle | |
| 1,614,039 | A | 1/1927 | Mandl | |
| 1,639,078 | A | 8/1927 | Coe | |
| 1,680,515 | A | 8/1928 | Gormley | |
| 1,957,462 | A | 5/1934 | Kress | 81/63 |
| 2,193,984 | A | 3/1940 | Rhinevault | 81/63.1 |
| 2,201,705 | A | 5/1940 | Stone | 192/43.2 |
| 2,201,827 | A | 5/1940 | Froeschl et al. | 192/43.2 |
| 2,317,461 | A | 4/1943 | Jackson | 81/60 |
| 2,542,241 | A | 2/1951 | Fors | 192/43 |
| 2,657,604 | A | 11/1953 | Rueb | 81/63.2 |
| 2,701,977 | A | 2/1955 | Stone | 81/63.2 |
| 2,735,324 | A | 2/1956 | Goldwater et al. | |
| 2,764,048 | A | 9/1956 | Thompson | 81/57 |
| 2,769,360 | A | 11/1956 | Cottrell et al. | 81/124.3 |
| 2,800,821 | A | 7/1957 | Fruscella | 81/60 |
| 2,891,434 | A | 6/1959 | Lozensky | 81/60 |
| 2,957,377 | A | 10/1960 | Hare | 81/63.2 |
| 2,978,081 | A | 4/1961 | Lundin | 192/43.1 |
| 3,019,682 | A | 2/1962 | Hare | 81/63.2 |
| 3,044,591 | A | 7/1962 | Kilness | 192/43.1 |
| 3,233,481 | A | 2/1966 | Bacon | 81/63 |
| 3,250,157 | A | 5/1966 | Badger | 81/63 |
| 3,265,171 | A | 8/1966 | Kilness | 192/43.2 |
| 3,337,014 | A | 8/1967 | Sandrick | 192/43.1 |
| 3,342,229 | A | 9/1967 | Janes | 145/71 |
| 3,393,587 | A | 7/1968 | Jolliff et al. | 81/63.2 |
| 3,393,780 | A | 7/1968 | Kilness | 192/43.2 |
| 3,436,992 | A | 4/1969 | Over et al. | 81/63.1 |
| 3,577,816 | A | 5/1971 | Alexander et al. | 81/63.1 |
| 3,606,940 | A | 9/1971 | Finkeldei | 192/43.1 |
| 3,713,356 | A | 1/1973 | Knudsen | 81/177.6 |
| 3,742,788 | A | 7/1973 | Priest | 81/61 |
| 3,783,703 | A | 1/1974 | Trimble et al. | 74/157 |
| 3,838,614 | A | 10/1974 | O'Donnell | 81/60 |
| 3,866,492 | A | 2/1975 | Knoll | 81/52.4 |
| 3,908,487 | A | 9/1975 | Plaw | 81/59.1 |
| 3,970,155 | A | 7/1976 | Otto | 73/139 |
| 4,053,037 | A | 10/1977 | Solomon | 192/43.1 |
| 4,070,932 | A | 1/1978 | Jeannotte | 81/177 |
| 4,111,077 | A | 9/1978 | Cummings et al. | 81/63 |
| 4,128,025 | A | 12/1978 | Main et al. | 81/63 |
| 4,147,076 | A | 4/1979 | Wright et al. | 81/63.2 |
| 4,257,507 | A | 3/1981 | Solomon | 192/43.1 |
| 4,274,311 | A | 6/1981 | Ebert | 81/63 |
| 4,277,989 | A | 7/1981 | Tracy | 81/62 |
| 4,277,990 | A | 7/1981 | Hall | 81/63 |
| 4,308,768 | A | 1/1982 | Wagner | 81/60 |
| 4,308,769 | A | 1/1982 | Rantanen | 81/63 |
| 4,328,720 | A | 5/1982 | Shiel | 81/63 |
| 4,336,728 | A | 6/1982 | Diebert | 81/62 |
| 4,406,186 | A | 9/1983 | Gummow | 81/60 |
| 4,420,995 | A | 12/1983 | Roberts | 81/60 |
| 4,485,700 | A | 12/1984 | Colvin | 81/62 |
| 4,488,460 | A | 12/1984 | Ballone et al. | 81/60 |
| 4,512,218 | A | 4/1985 | Chow | 81/62 |
| 4,520,697 | A | 6/1985 | Moetteli | 81/62 |
| 4,631,988 | A | 12/1986 | Colvin | 81/62 |
| 4,662,251 | A | 5/1987 | Kohal | 81/58 |
| 4,709,600 | A | 12/1987 | Mierbach et al. | 81/57.39 |
| 4,722,252 | A | 2/1988 | Fulcher et al. | 81/57.39 |
| 4,722,253 | A | 2/1988 | Chow | 81/63 |
| 4,762,033 | A | 8/1988 | Chow | 81/63.2 |
| 4,770,072 | A | 9/1988 | Neuhaus | 81/63.2 |
| 4,777,852 | A | 10/1988 | Herman et al. | 81/63.1 |
| 4,796,492 | A | 1/1989 | Liou | 81/58 |
| 4,807,500 | A | 2/1989 | Main | 81/63.1 |
| 4,862,775 | A | 9/1989 | Chow | 81/63.2 |
| 4,869,138 | A | 9/1989 | Farris | 81/63 |
| 4,903,554 | A | 2/1990 | Colvin | 81/63 |
| 4,924,737 | A | 5/1990 | Gummow | 81/63.2 |
| 4,934,220 | A | 6/1990 | Slusar et al. | 81/63.2 |
| 4,986,147 | A | 1/1991 | Cooper | 81/63.2 |
| 4,991,468 | A | 2/1991 | Lee | 81/60 |
| 5,012,705 | A | 5/1991 | Chow | 81/63 |
| 5,076,121 | A | 12/1991 | Fosella | 81/58.4 |
| 5,144,869 | A | 9/1992 | Chow | 81/63 |
| 5,157,994 | A | 10/1992 | Krivec | 81/63.2 |
| 5,178,047 | A | 1/1993 | Arnold et al. | 81/63.2 |
| 5,199,330 | A | 4/1993 | Arnold et al. | 81/63.2 |
| 5,199,335 | A | 4/1993 | Arnold et al. | 81/177.8 |
| 5,230,262 | A | 7/1993 | Ahlund et al. | 81/63.2 |
| 5,231,903 | A | 8/1993 | Bockman, Jr. | |
| 5,233,891 | A | 8/1993 | Arnold et al. | 81/60 |
| 5,271,300 | A | 12/1993 | Zurbuchen et al. | |
| 5,295,422 | A | 3/1994 | Chow | |
| 5,347,892 | A | 9/1994 | Moetteli | 81/177.85 |
| 5,392,672 | A | 2/1995 | Larson et al. | |
| 5,404,773 | A | 4/1995 | Norville | 81/63.1 |
| 5,425,291 | A | 6/1995 | Chang | 81/59.1 |
| 5,448,931 | A | 9/1995 | Fossella et al. | 81/63.2 |
| 5,467,672 | A | 11/1995 | Ashby | |
| 5,477,757 | A | 12/1995 | Maresh | |
| 5,495,783 | A | 3/1996 | Slusar et al. | 81/63.2 |
| 5,499,560 | A | 3/1996 | Aeschliman | 81/63.2 |
| 5,501,124 | A | 3/1996 | Ashby | 81/58.2 |
| 5,509,333 | A | 4/1996 | Rion | 81/180.1 |
| 5,522,288 | A | 6/1996 | Slusar et al. | 81/63 |
| 5,533,427 | A | 7/1996 | Chow | 81/63.2 |
| 5,535,646 | A | 7/1996 | Allen et al. | 81/57.39 |
| 5,557,994 | A | 9/1996 | Nakayama | 81/478 |
| 5,582,081 | A | 12/1996 | Lin | 81/63.1 |
| 5,584,220 | A | 12/1996 | Darrah et al. | |
| 5,595,095 | A | 1/1997 | Hillinger | 81/58.3 |
| 5,626,061 | A | 5/1997 | Whitley | 81/63 |
| 5,626,062 | A | 5/1997 | Colvin | 81/63.2 |
| 5,636,557 | A | 6/1997 | Ma | 81/60 |
| 5,669,875 | A * | 9/1997 | van Eerdenburg | 604/22 |
| 5,709,137 | A | 1/1998 | Blacklock | 81/467 |
| 5,782,147 | A | 7/1998 | Chaconas et al. | 81/63.1 |
| 5,794,496 | A | 8/1998 | Arnold | 81/63.2 |
| 5,829,326 | A | 11/1998 | Richner | 81/60 |
| 5,842,391 | A | 12/1998 | Chaconas | 81/62 |
| 5,857,390 | A | 1/1999 | Whiteford | 81/62 |
| 5,873,286 | A | 2/1999 | Van Lenten | 74/575 |
| 5,878,635 | A | 3/1999 | Hsieh | 81/61 |
| 5,884,537 | A | 3/1999 | Chen | 81/58.4 |
| 5,884,538 | A | 3/1999 | Van Lenten | 81/63 |
| 5,887,493 | A | 3/1999 | Main | 81/57.29 |
| 5,901,620 | A | 5/1999 | Arnold | 81/63.2 |
| 5,910,197 | A | 6/1999 | Chaconas | 81/124.6 |
| 5,911,798 | A | 6/1999 | Arnold | 81/177.2 |
| 5,913,954 | A | 6/1999 | Arnold et al. | 81/63.2 |
| 5,927,158 | A | 7/1999 | Lin | 81/60 |
| 5,946,987 | A | 9/1999 | Wei | 81/63.2 |
| 5,946,989 | A | 9/1999 | Hsieh | 81/124.3 |
| 5,957,009 | A | 9/1999 | McCann | 81/63.2 |
| 5,964,129 | A | 10/1999 | Shiao | 81/63.2 |
| 5,970,552 | A | 10/1999 | Kwiecien et al. | 7/143 |
| 5,979,274 | A | 11/1999 | Hsieh | 81/60 |
| 5,996,453 | A | 12/1999 | Blacklock | 81/467 |
| 6,000,302 | A | 12/1999 | Chiang | 81/177.8 |
| 6,006,631 | A | 12/1999 | Miner et al. | 81/177.85 |
| 6,044,731 | A | 4/2000 | Hsieh | 81/63.2 |
| 6,065,374 | A | 5/2000 | Taggart | 81/63.2 |
| 6,125,722 | A | 10/2000 | Hopper, Jr. et al. | 81/63 |
| 6,134,990 | A | 10/2000 | Ling et al. | 81/60 |

| | | | | |
|---|---|---|---|---|
| 6,134,991 | A | 10/2000 | Chaconas | 81/63 |
| D433,896 | S | 11/2000 | Wei | D8/28 |
| D434,292 | S | 11/2000 | Hsieh | D8/28 |
| 6,148,695 | A | 11/2000 | Hu | 81/60 |
| 6,152,826 | A | 11/2000 | Profeta et al. | 464/159 |
| 6,155,140 | A | 12/2000 | Tsai | 81/61 |
| 6,161,454 | A | 12/2000 | Chaconas | 81/63.2 |
| 6,164,167 | A | 12/2000 | Chen | 81/63.2 |
| 6,205,889 | B1 | 3/2001 | Hsieh | 81/60 |
| 6,209,423 | B1 | 4/2001 | Shiao | 81/62 |
| 6,216,563 | B1 | 4/2001 | Hsieh | 81/63.2 |
| 6,216,567 | B1 | 4/2001 | Hu | 81/177.9 |
| 6,220,123 | B1 | 4/2001 | Chen | 81/63.2 |
| 6,230,591 | B1 | 5/2001 | Ling et al. | 81/63 |
| 6,240,813 | B1 | 6/2001 | Hyatt | 81/124.6 |
| 6,257,096 | B1 | 7/2001 | Ling | 81/60 |
| 6,257,097 | B1 | 7/2001 | I-He | |
| 6,260,448 | B1 | 7/2001 | Chaconas | 81/63 |
| 6,260,449 | B1 | 7/2001 | I-He | |
| 6,263,767 | B1 | 7/2001 | Hu | 81/60 |
| 6,282,991 | B1 | 9/2001 | Hu | 81/63.2 |
| 6,282,992 | B1 | 9/2001 | Hu | 81/63.2 |
| 6,282,993 | B1 | 9/2001 | Forman et al. | 81/63.2 |
| 6,301,998 | B1 | 10/2001 | Hu | 81/60 |
| 6,334,373 | B1 | 1/2002 | Hsieh | 81/60 |
| 6,382,052 | B1 | 5/2002 | Chen | |
| 6,386,072 | B1 | 5/2002 | Yuan-Chin et al. | |
| 6,431,031 | B1 | 8/2002 | Hu | 81/63.2 |
| 6,435,062 | B1 | 8/2002 | McCann | 81/63 |
| 6,435,063 | B1 | 8/2002 | Chen | 81/63.2 |
| 6,450,066 | B1 | 9/2002 | Hu | 81/60 |
| 6,450,068 | B1 | 9/2002 | Hu | 81/63.2 |
| 6,453,779 | B2 | 9/2002 | Hu | 81/63 |
| 6,457,387 | B1 | 10/2002 | Hu | 81/63.2 |
| 6,457,388 | B1 | 10/2002 | Chen | |
| 6,457,389 | B1 | 10/2002 | Hu | 81/63.2 |
| 6,488,136 | B2 | 12/2002 | Chang | 192/46 |
| 6,520,051 | B1 | 2/2003 | Hu | |
| 2001/0035074 | A1 | 11/2001 | Hu | 81/63 |
| 2002/0017169 | A1 | 2/2002 | Hu | 81/63.1 |
| 2002/0023519 | A1 | 2/2002 | Hu | 81/63.2 |
| 2002/0023520 | A1 | 2/2002 | Hu | 81/63.2 |
| 2002/0026858 | A1 | 3/2002 | Hu | 81/63.1 |
| 2002/0062718 | A1 | 5/2002 | Wang | |
| 2002/0088312 | A1 | 7/2002 | Ling et al. | 81/63.2 |
| 2002/0112573 | A1 | 8/2002 | Hu | 81/63.2 |
| 2002/0162423 | A1 | 11/2002 | Hu | 81/60 |
| 2002/0162424 | A1 | 11/2002 | Hu | 81/60 |
| 2002/0166416 | A1 | 11/2002 | Hu | 81/63.2 |
| 2002/0166417 | A1 | 11/2002 | Hu | 81/63.2 |
| 2002/0194950 | A1 | 12/2002 | Hu | |
| 2003/0010159 | A1 | 1/2003 | Hu | |
| 2003/0010163 | A1 | 1/2003 | Hu | |
| 2003/0010164 | A1 | 1/2003 | Hu | |
| 2003/0019355 | A1 | 1/2003 | Hu | |

FOREIGN PATENT DOCUMENTS

| | | |
|---|---|---|
| CN | 212343 | 5/1982 |
| CN | 310649 | 1/1986 |
| DE | 3 73 436 | 4/1923 |
| DE | 921 198 | 12/1954 |
| DE | 1 810 811 | 6/1970 |
| DE | 299 07 467 | 9/1999 |
| DE | 299 10 932 | 9/1999 |
| GB | 1 559 093 | 1/1980 |
| GB | 2 135 226 | 8/1984 |

OTHER PUBLICATIONS

Office Action by Taiwan Property Office on Opposition to Patent Application No. 089200570 in Taiwan and Translation; and Translations of Taiwanese Patent Publication No. 212343, of Taiwanese Patent Publication No. 310649, and of Taiwanese Patent Publication No. 130638; (11 p.).

Decision by the Board of Appeal and Translation of same;(13 p.).

Taiwan Intellectual Property Office's Answer to Appeal Brief and Translation of same (5 p.).

Civil Action No. 302CV1723; In the United States District Court for the District of Connecticut; *EASO Hand Tools, Inc. et al* vs. *Hu, Hou-Fei*, a/k/a Bobby Hu; *Complain for the Declaratory Judgment of Noninfringement, Unenforceability and Invalidity of a Patent*; filed Sep. 26, 2002.

Civil Action No. 302CV1747 (AVC); In the United States District Court for the District of Connecticut; *EASO Hand Tools, Inc. et al* vs. *Hu, Hou-Fei*, a/k/a Bobby Hu; *Amended Complain for the Declaratory Judgment of Noninfringement, Unenforceability and Invalidity of a Patent*; filed Sep. 26, 2002.

Civil Action No. 302CV1723; In the United States District Court for the District of Connecticut; *EASO Hand Tools, Inc. et al* vs. *Hu, Hou-Fei*, a/k/a Bobby Hu; *Plaintiffs' Second Supplemental Resposne to Interrogatory No. 3 of Defendant's First Set of Interrogatories*; filed Apr. 21, 2004.

Request for continuing Examination, Amendment, and Response to Final Office Action Dated Mar. 8, 2005; U.S. Appl. No. 10/621,552, Dated Aug. 8, 2005; (pp. 10).

Appeal Brief against Office Action on Opposition to Patent Application No. 089200570 P01 in Taiwan and translation of same (31 p.).

EPO Search Report for Appl. No. EP 00 12 6902 dated Feb. 17, 2004 (3 p.).

* cited by examiner 6-6

7-7

REVERSIBLE RATCHETING TOOL WITH A SMALLER HEAD AND IMPROVED DRIVING TORQUE

CROSS REFERENCE

This application is a division of U.S. application Ser. No. 09/523,625 filed Mar. 13, 2000 now U.S. Pat. No. 6,457,387.

BACKGROUND OF THE INVENTION

1. Field of the Invention

The present invention relates to a reversible ratcheting tool having a smaller head and improved driving torque for convenient use in a limited space.

2. Description of the Related Art

A wide variety of ratcheting tools have heretofore been disclosed. Typical examples include: U.S. Pat. No. 1,957,462 to Kress issued on May 8, 1934; U.S. Pat. No. 4,328,720 to Shiel issued on May 11, 1982; U.S. Pat. No. 5,626,062 to Colvin issued on May 6, 1997; U.S. Pat. No. 4,762,033 to Chow issued on Aug. 9, 1988; U.S. Pat. No. 4,520,697 to Moetteli issued on Jun. 4, 1985; U.S. Pat. No. 3,337,014 to Sandrick issued on Aug. 22, 1967; and U.S. Pat. No. 5,144,869 to Chow issued on Sep. 8, 1992. Most of the above-mentioned conventional ratcheting tools fail to provide high torque operation, as the pawls merely engage with the ratchet wheel by at best three or five teeth. The head of the ratcheting tool has to be relatively large for accommodating those components and thus is difficult to be used in a limited space. In addition, the pawl is directly driven by the switch button or reverser plate or like element such that the pawl tends to be disengaged from the ratchet wheel or like element if the switch block is inadvertently impinged. Generally, a skilled user uses a combination wrench, a spanner with two open ends, or a ring spanner for tightening or loosening a fastener in a limited space. Yet, it is found that free rotation of the ratcheting tool during ratcheting is too large (larger than the theoretic value of 5°), as the pawl has a long travel.

U.S. Pat. No. 6,431,031 issued on Aug. 13, 2002 discloses a reversible ratcheting tool with a smaller head to solve the above problems.

FIG. 8 illustrates engagement between a gear wheel 80 and a pawl 81 of a conventional ratcheting tool. The pawl 81 has a plurality of teeth engaged with teeth 83 of the gear wheel 80 at faces 82 so as to provide high torque operation. The faces 82 have a center of curvature at "B", which is coincident with the center of the gear wheel 80. Referring to FIG. 9, when the handle (not shown) is rotated clockwise, the gear wheel 80 exerts a force F on each tooth on the pawl 81. The force F is imparted into a downward vertical force F1 and a leftward horizontal force F2. The leftward horizontal force F2 makes the pawl 81 bear against point A on a wall in a cavity in a web area of the handle. The downward vertical force F1 moves the pawl 81 away from the gear wheel 80. As a result, the right portion of the pawl 81 is disengaged from the gear wheel 80. The reactive force by the wall at point A is imparted into an upward vertical force FN1 and a rightward horizontal force FN2. The upward vertical force FN1 makes the pawl 81 move toward the gear wheel 80 and the rightward horizontal force FN2 moves the pawl 81 rightward. As a result, the pawl 81 and the gear wheel 80 have a firm engagement with each associated tooth of the gear wheel at point D.

Referring to FIG. 10, when the handle is further rotated clockwise, a higher torque is applied such that the magnitudes of the forces F1 and F2 increase. The right portion of the pawl teeth that is slightly disengaged from the gear wheel teeth 83 can still be in contact with the gear wheel teeth 83 when the gear wheel 80 is rotated. The right portion of the pawl 81 is moved downward farther. As a result, more teeth on the pawl 81 are disengaged from the gear wheel 80 (see the pawl teeth on the right side of point A). The forces FN1 and FN2 are also increased in magnitude, yet fewer pawl teeth have firm engagement with the gear wheel teeth. This problem is aggravated when the handle is further rotated clockwise. Accordingly, the gear wheel/pawl arrangement fails to provide the required high torque operation, as all of the pawl teeth have the same center of curvature. In addition, the pawl and the gear wheel will be damaged quickly.

The present invention is intended to provide an improved design in this regard to improve the driving torque for reliable high-torque operation.

SUMMARY OF THE INVENTION

It is a primary object of the present invention to provide a reversible ratcheting tool with a small head while providing improved driving torque for convenient use in a limited space.

A ratcheting tool in accordance with the present invention comprises:

a handle;

a head extended from the handle and having a compartment therein;

a drive member including a first end extended beyond the compartment, a second end extended beyond the compartment, and a gear wheel formed between the first end and the second end, the gear wheel being rotatably mounted in the compartment and including an outer periphery with a plurality of first teeth;

a pawl mounted in the compartment and including a first side with a plurality of second teeth facing the first teeth of the gear wheel and a second side facing away from the gear wheel, the second teeth of the pawl including a first teeth portion having a first center of curvature and a second teeth portion having a second center of curvature located at a position different from the first center of curvature;

a ring mounted in the compartment and around the first end of the drive member, the ring being operably connected to the pawl such that the ring and the pawl are pivotable about a rotational axis of the gear wheel and that the pawl is movable in a radial direction relative to the ring;

a reversing plate mounted to the first end of the drive member and pivotable about the rotational axis of the gear wheel between a first position and a second position;

means for retaining the reversing plate in position; and means for providing transmission between the reversing plate and the pawl for moving the pawl between a first ratcheting position and a second ratcheting position, wherein the first teeth portion of the pawl is engaged with the first teeth of the gear wheel for ratcheting in a first direction and the second teeth portion of the pawl is disengaged from the first teeth of the gear wheel when the pawl is in the first ratcheting position, and wherein the second teeth portion of the pawl is engaged with the first teeth of the gear wheel for ratcheting in a second direction opposite to the first direction and the first teeth portion of the pawl is disengaged from the first teeth of the gear wheel when the pawl is in the second ratcheting position.

The first center of curvature of the pawl is coincident with a center of the gear wheel when the pawl is in the first ratcheting position. The second center of curvature of the pawl is coincident with the center of the gear wheel when the pawl is in the second ratcheting position. Thus, the total number of pawl teeth actually and reliably engaged with the gear wheel in accordance with the present invention during ratcheting is greater than that in conventional designs, and such advantage is the result of the novel design in the first and second teeth portions of the pawl.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
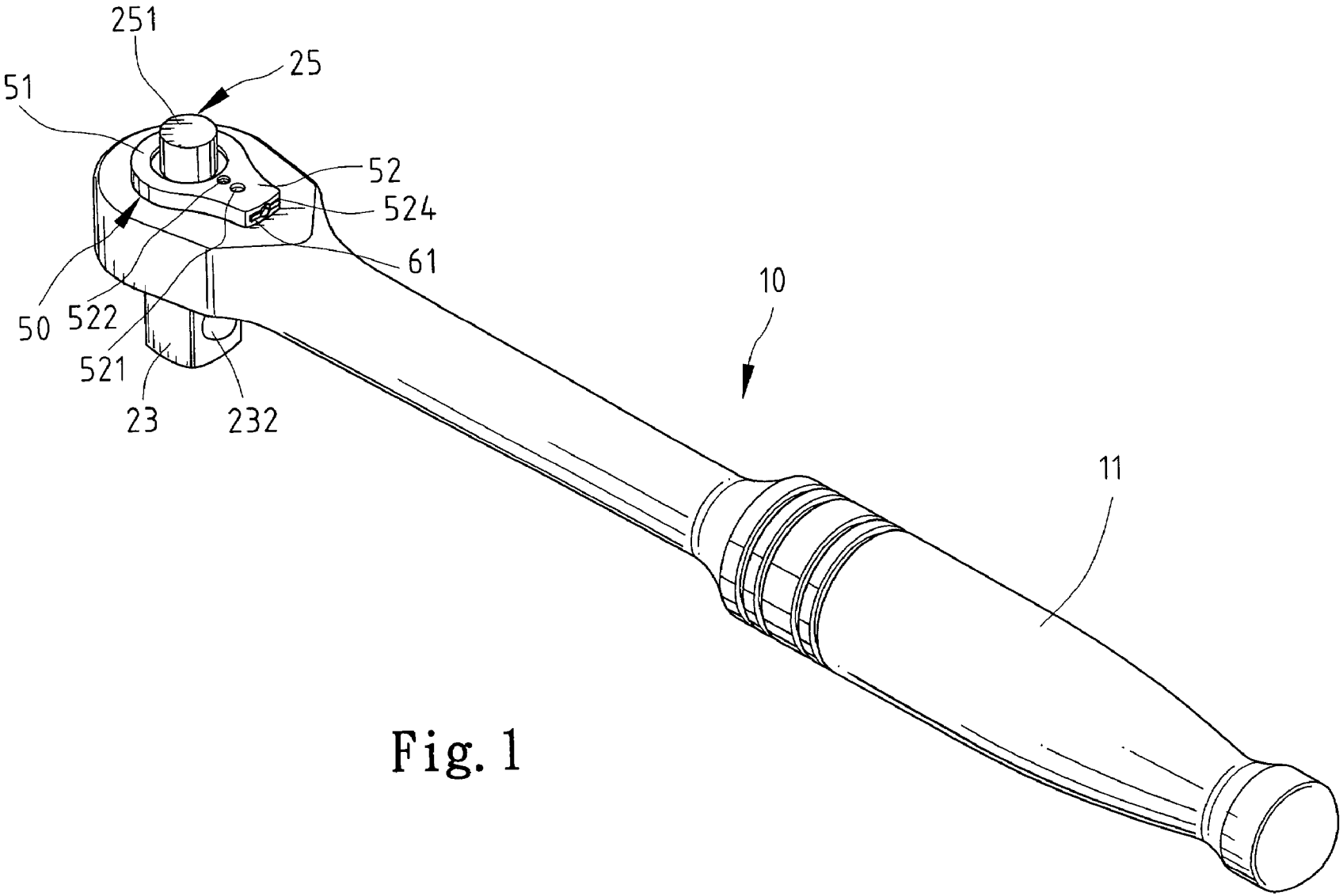
FIG. 1 is a perspective view of a reversible ratcheting tool in accordance with the present invention.
Figure 2:
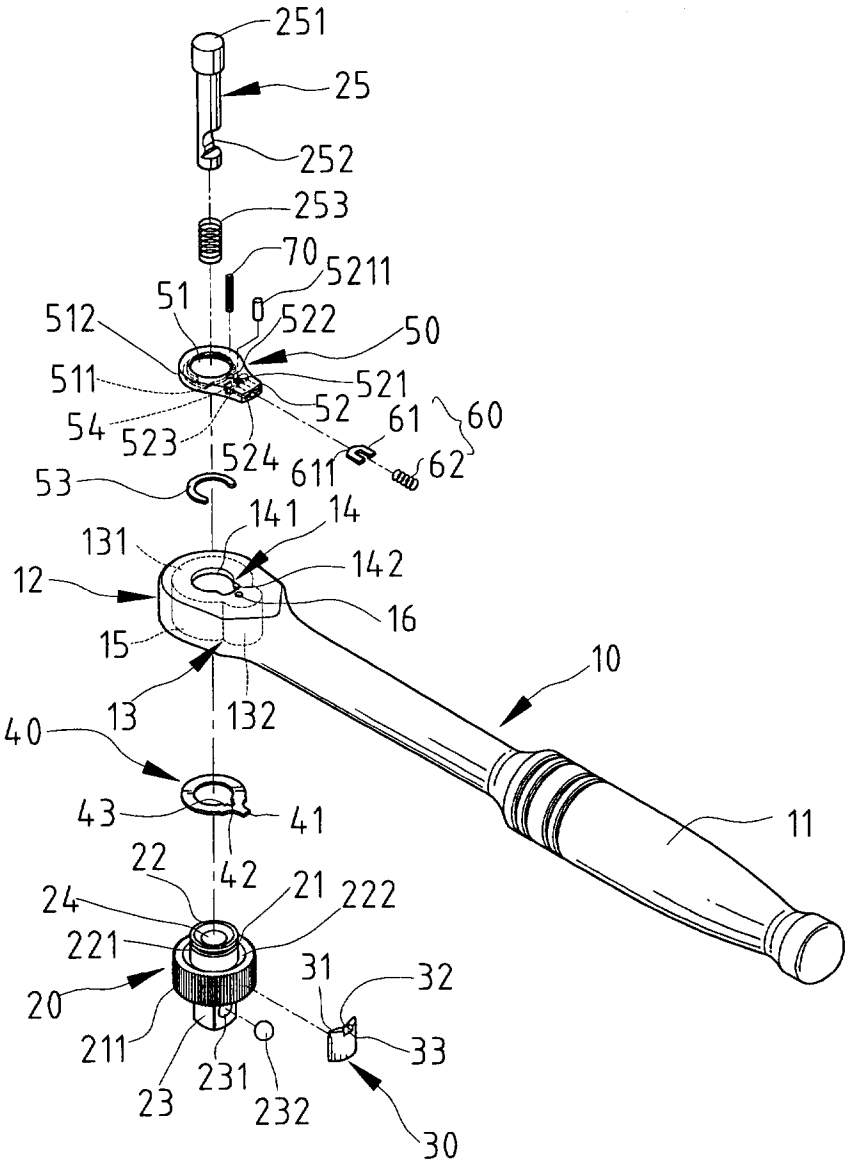
FIG. 2 is an exploded perspective view of the reversible ratcheting tool in FIG. 1.
Figure 6:
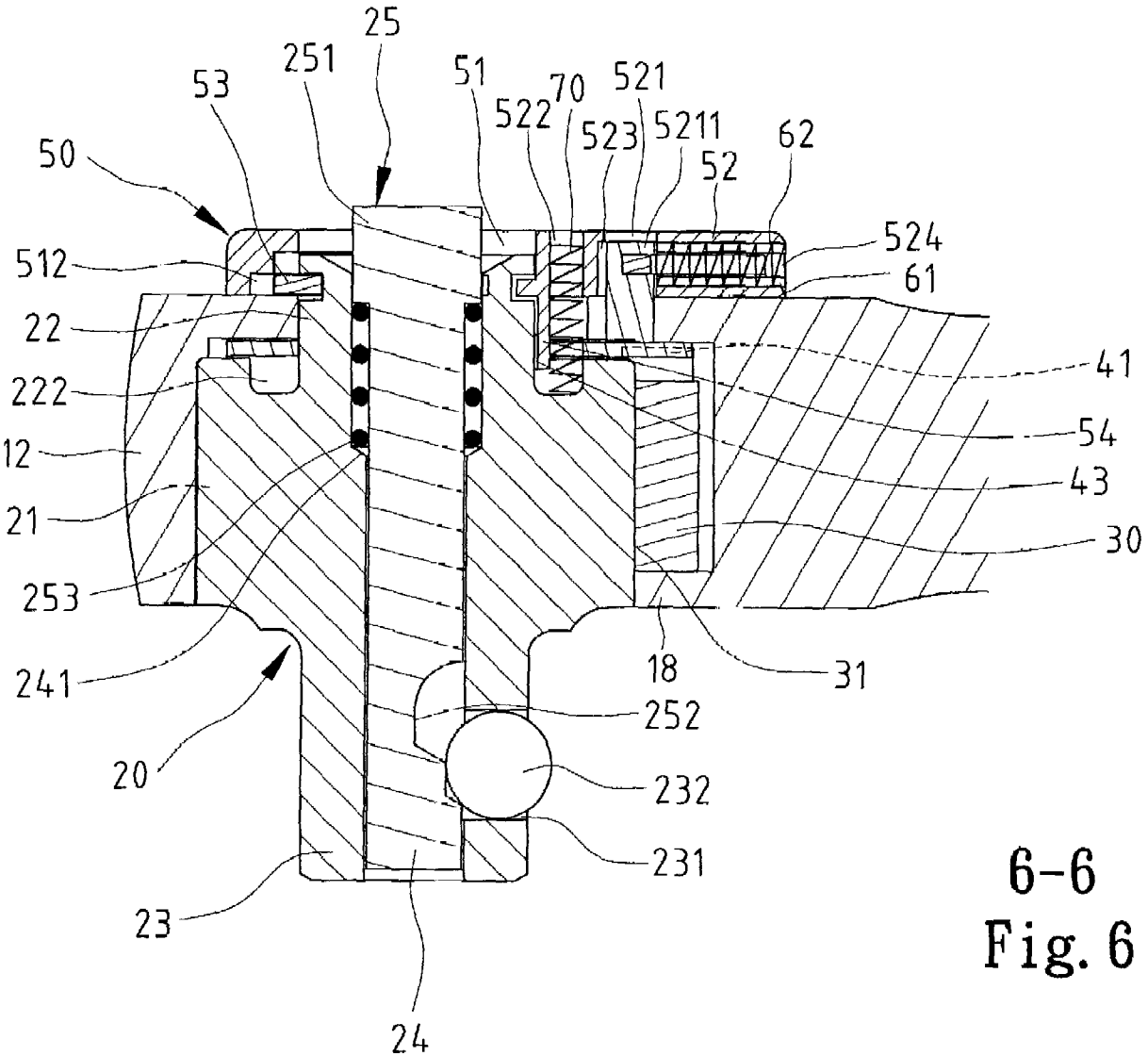
FIG. 6 is a sectional view taken along line 6-6 in FIG. 4.

Referring to FIGS. 1, 2, and 6, a ratcheting tool in accordance with the present invention is designated by 10 and has a handle 11 and a head 12 extended from the handle 11. The head 12 is substantially circular and has a minimized volume. The head 12 includes a compartment 13 consisting of a relatively larger first compartment section 131 and a relatively smaller second compartment section 132. A top face (not labeled) of the head 12 includes an opening 14 consisting of a circular opening section 141 that is concentric with the first compartment section 131 and a rectangular opening section 142. The top face of the head 12 further includes a hole 16 adjacent to the opening section 142. Defined in a lower end of the head 12 is a circular hole 15 that is concentric with the first compartment section 131 and has a diameter the same as that of the first compartment section 131. The lower end of the head 12 is formed with a ledge 18 (FIG. 6) that defines a portion of the second compartment section 132.

Rotatably mounted in the head 12 is a drive member 20 having an upper end 22, a drive column 23 on a lower end thereof, and a gear wheel 21 formed in an intermediate portion thereof. The gear wheel 21 is rotatably received in the first compartment 131 of the head 12 and includes teeth 211 formed on an outer periphery thereof. The upper end 22 of the drive member 20 includes an engaging groove 221, and an annular groove 222 is defined in a side of the gear wheel 21. The drive column 23 includes a hole 231 for receiving a ball 232. The drive member 20 further includes a central through-hole 24 with a shoulder portion 241, which will be described later.

Still referring to FIGS. 1, 2, and 6, a pushpin 25 is mounted in the through-hole 24 of the drive member 20 and includes an enlarged upper end 251 for manual pressing. A lower end of the pushpin 25 includes a stepped groove 252 for receiving a portion of the ball 232 when the pushpin 25 is pushed, thereby allowing disengagement of the drive column 23 from a socket (not shown). An elastic member 253 is mounted around the pushpin 25 and attached between the shoulder portion 241 of the through-hole 24 and the enlarged end 251 of the pushpin 25. The elastic member 253 biases the pushpin 25 upward for moving the ball 232 outward to an engaging position for engaging with a socket, which is conventional and therefore not further described. The ball 232 in the engaging position is engaged with the stepped groove 252 to thereby prevent disengagement of the pushpin 25.

Figure 2A:
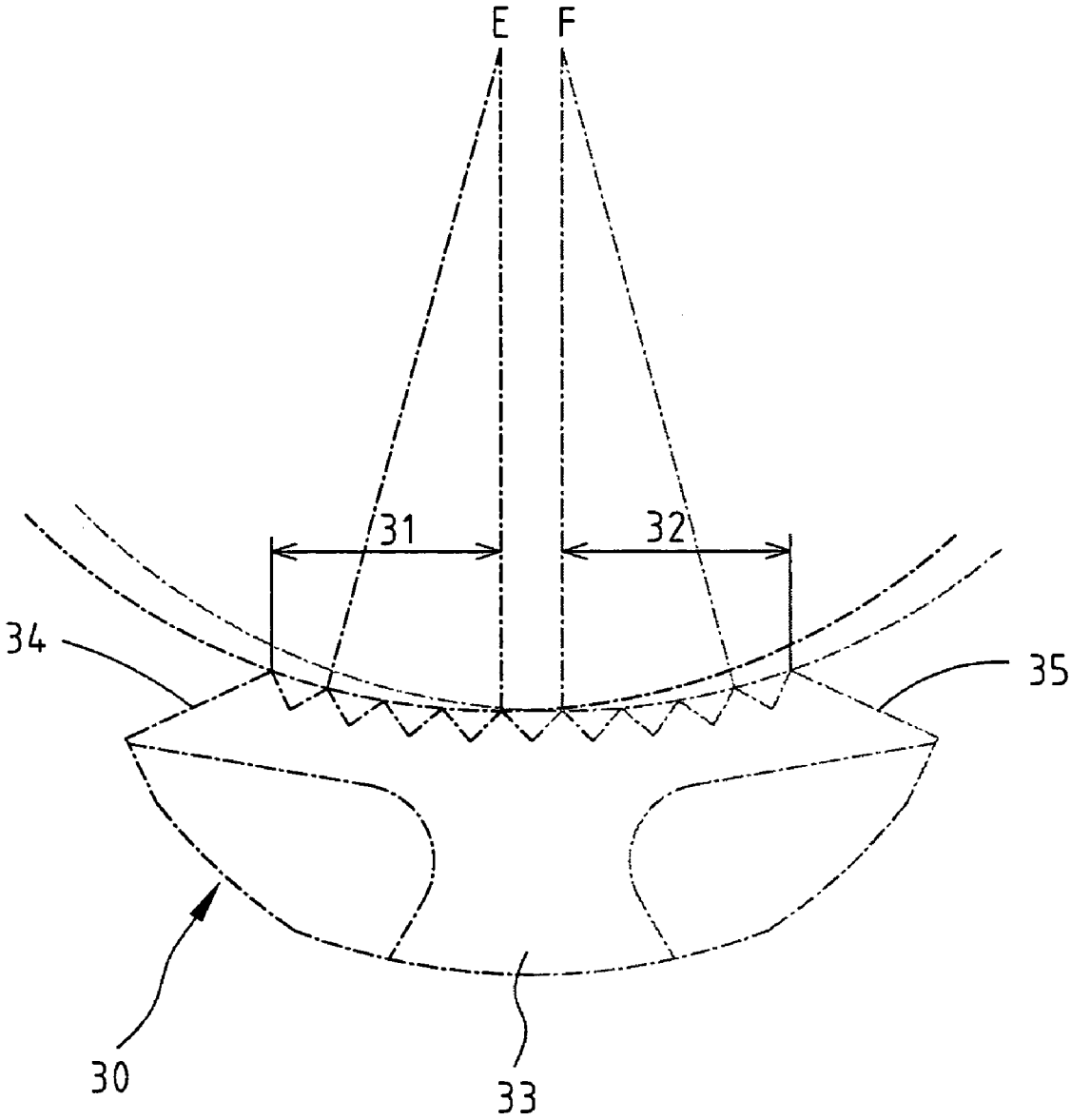
FIG. 2A is a schematic view, in an enlarged scale, illustrating a pawl of the reversible ratcheting tool in accordance with the present invention.

A pawl 30 is mounted in the second compartment section 132 and includes a side facing the gear wheel teeth 211. Referring to FIG. 2A, the side of the pawl 30 has a plurality of teeth (ten teeth in this embodiment) for engaging with the gear wheel teeth 211, thereby providing reliable mesh therebetween. The pawl 30 includes a recess 33 on a top thereof. Of more importance, as illustrated in FIG. 2A, the teeth on the side of the pawl 30 includes a first teeth portion 31 having a center of curvature at "E" and a second teeth portion 32 having a center of curvature at "F". Namely, the centers of curvatures for the teeth portions 31 and 32 are located at different positions "E" and "F", the purpose of which will be described later. The first teeth portion 31 and the second teeth portion 32 may be arranged in a continuous or noncontinuous manner. The side of the pawl 30 also includes first and second faces 34, 35 extending outwardly on opposite sides of the plurality of teeth and interconnected to the other side of the pawl.

Figure 2B:
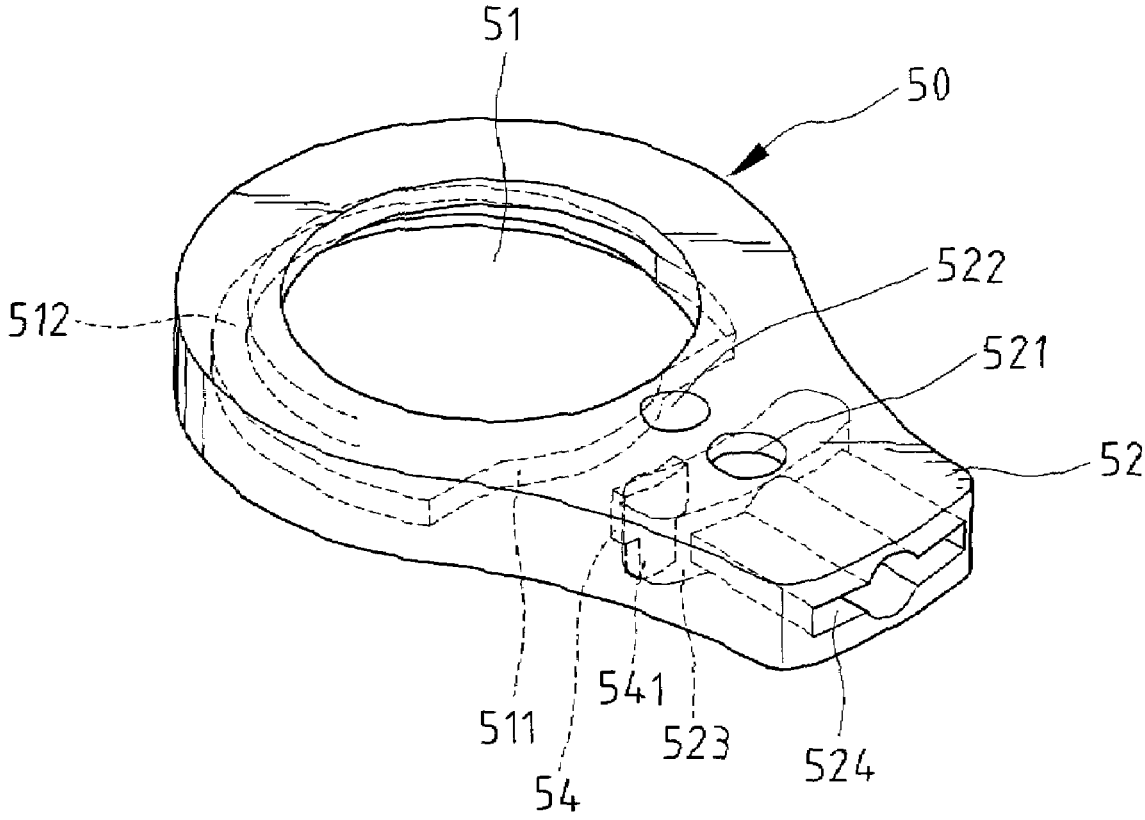
FIG. 2B is an enlarged perspective view illustrating a reversing plate of the reversible ratcheting tool in accordance with the present invention.
Figure 2C:
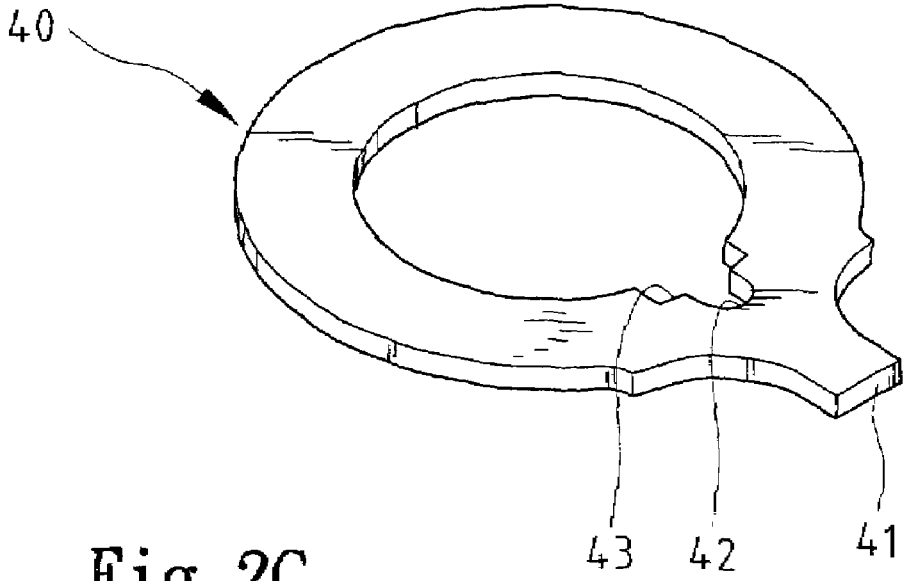
FIG. 2C is an enlarged perspective view illustrating a ring of the reversible ratcheting tool in accordance with the present invention.

Still referring to FIGS. 1, 2, and 6, a ring 40 is pivotally mounted around the upper end 22 of the drive member 20. As illustrated in FIG. 2C, a tip piece 41 projects outward from the ring 40 and is engaged in the recess 33 of the pawl 30 to move therewith. A notch 42 is defined in an inner periphery of the ring 40 and aligned with the annular groove 222 of the drive member 20. The notch 42 of the ring 40 further includes an enlarged section 43, which will be described later.

A reversing plate 50 is mounted around the upper end 22 of the drive member 20 and includes a hole 51 and a thumb piece 52. As illustrated in FIG. 6, the enlarged upper end 251 of the pushpin 25 extends through the circular opening section 141 of the head 12 and beyond the hole 51 of the reversing plate 50 for manual operation. Referring to FIG. 2B, a positioning piece 511 projects radially inward from an inner periphery of the hole 51 of the reversing plate 50 in a portion adjacent to the thumb piece 52. The inner periphery of the hole 51 of the reversing plate 50 further includes a cavity 512 facing the positioning piece 511. A C-clip 53 is mounted around a portion of the engaging groove 221 of the upper end 22 of the drive member 20, thereby retaining the upper end 22 of the drive member 20 to the top face of the head 12. The C-clip 53 is partially accommodated in the cavity 512 of the reversing plate 50. In addition, the positioning piece 511 is extended into the remaining portion of the engaging groove 221 of the drive member 20. Thus, the reversing plate 50 is pivotally mounted to the upper end 22 of the drive member 20. The thumb piece 52 of the reversing plate 50 further includes two through-holes 521 and 522. An arcuate groove 523 is defined in an underside of the thumb piece 52 and communicated with the through-hole 521. The thumb piece 52 includes a receptacle 524 that is communicated with the arcuate groove 523. A retainer block 54 is formed on a bottom of the reversing plate 50 and projects downward from a position between the through-hole 522 and the hole 51. The retainer block 54 includes a lower end 541 that is pivotally movable in the enlarged section 43 of the ring 40, which will be described later.

A retaining means 60 is mounted in the receptacle 524 of the thumb piece 52 and includes a substantially U-shape slide piece 61 and an elastic member 62. The slide piece 61 includes a tapered push-face 611 consisting of two faces (not labeled) separated by a tip (not labeled, see FIG. 2). The elastic member 62 is received between two limbs (not labeled) of the U-shape slide piece 61. In practice, an end face of the receptacle 524 is pressed to form a configuration for preventing disengagement of the elastic member 62 from the receptacle 524 yet allowing movement of the slider piece 61 relative to the elastic member 62.

A pin 5211 is inserted through the through-hole 521 of the thumb piece 52 with a lower end of the pin 5211 extended through the arcuate groove 523 and into the hole 16 of the head 12. Thus, the pin 5211 is retained in the hole 16. As a result, the arcuate groove 523 is movable relative to the pin 5211 during pivotal movement of the reversing plate 50. The push-face 611 of the slide piece 61 may retain the pin 5211 in place. In addition, as the pin 5211 is retained in place and the positioning piece 511 of the reversing plate 50 is engaged in the engaging groove 221 of the drive member 20, the reversing plate 50 is securely yet pivotally engaged with the upper end 22 of the drive member 20.

A transmission member 70 is provided to convert manual pivotal movement of the reversing plate 50 into pivotal movement of the pawl 30 about the rotational axis of the gear wheel 21. In this embodiment, the transmission member 70 is in the form of a spring having a relatively small pitch. The transmission member 70 is extended in the through-hole 522 of the reversing plate 50, the rectangular opening section 142 of the head 12 of the handle 11, and the notch 42 of the ring 40 and then into the annular groove 222 of the drive member 20.

Figure 4:
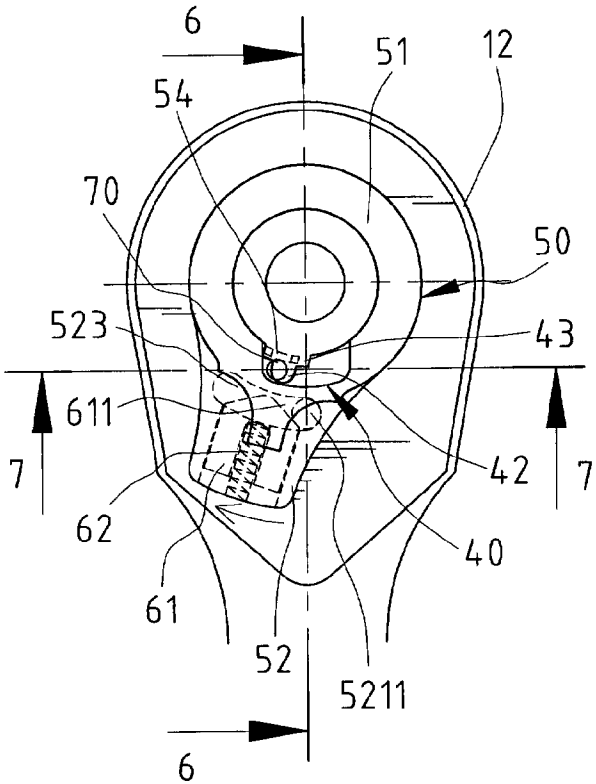
FIG. 4 is a sectional view similar to FIG. 3, wherein the reversible ratcheting tool is in a status allowing clockwise ratcheting.
Figure 7:
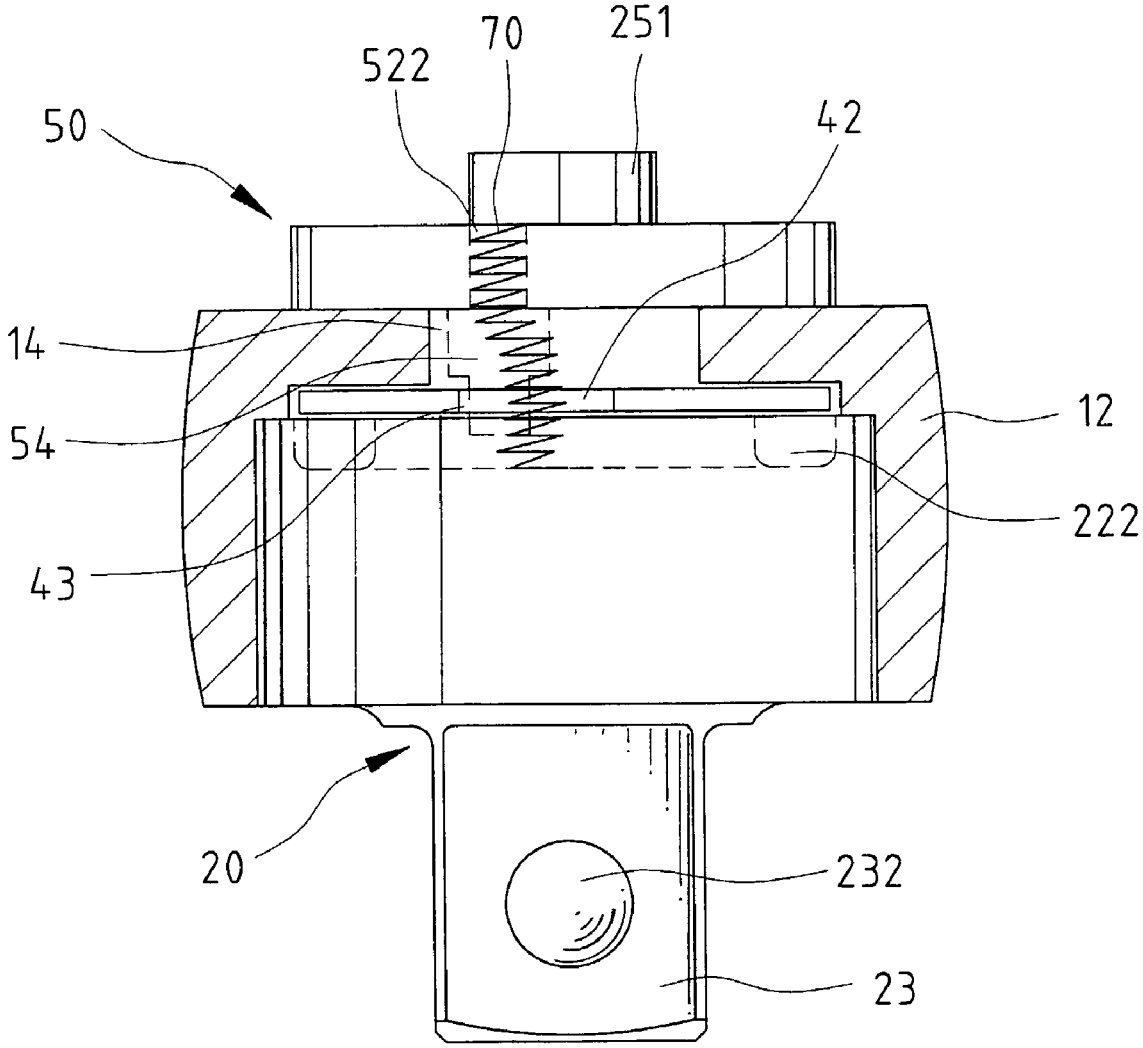
FIG. 7 is a sectional view taken along line 7-7 in FIG. 4.
Figure 8:
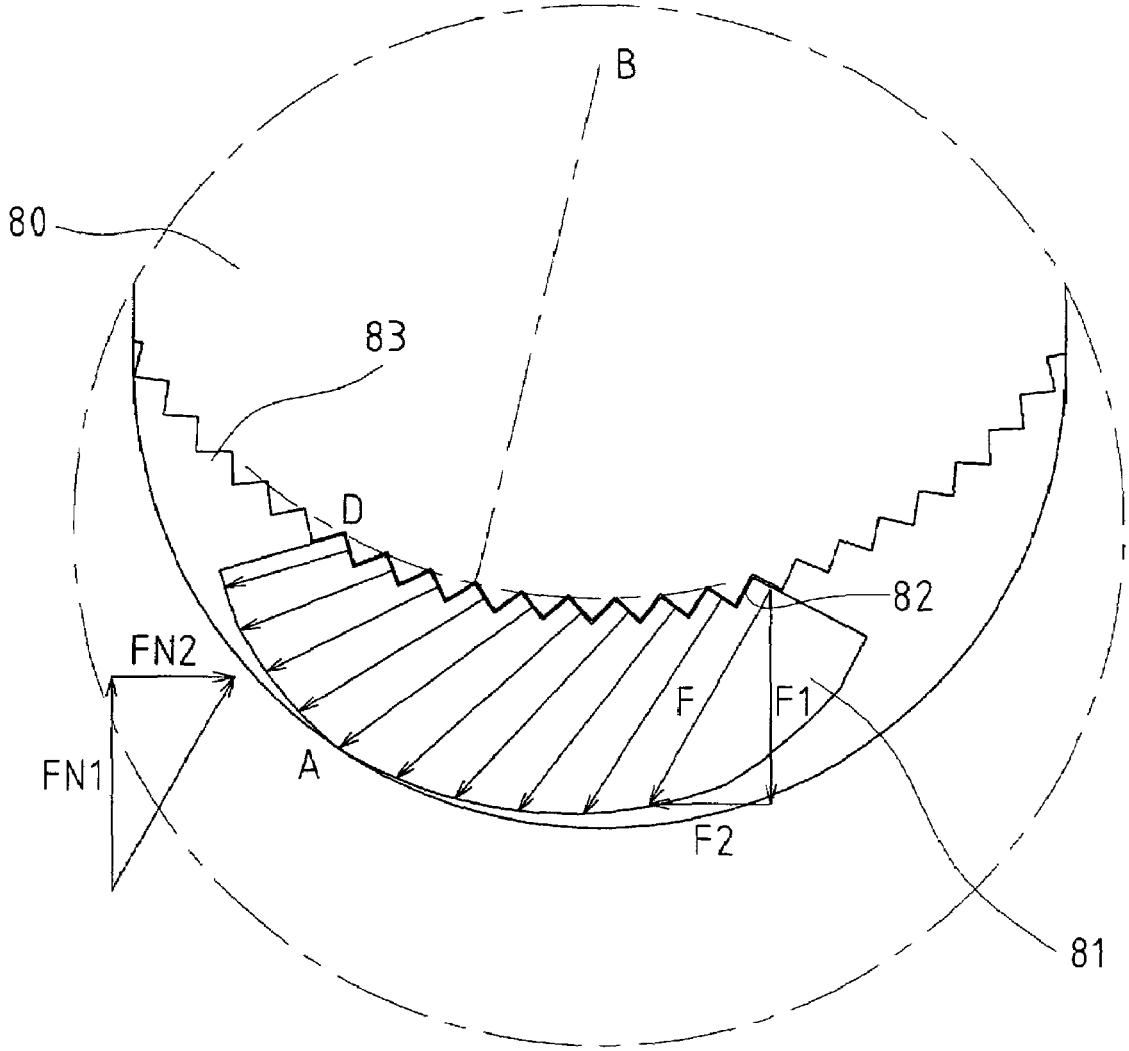
Fig. 8 PRIOR ART
FIG. 8 is a schematic view illustrating engagement between a gear wheel and a pawl of a conventional ratcheting tool.
Figure 9:
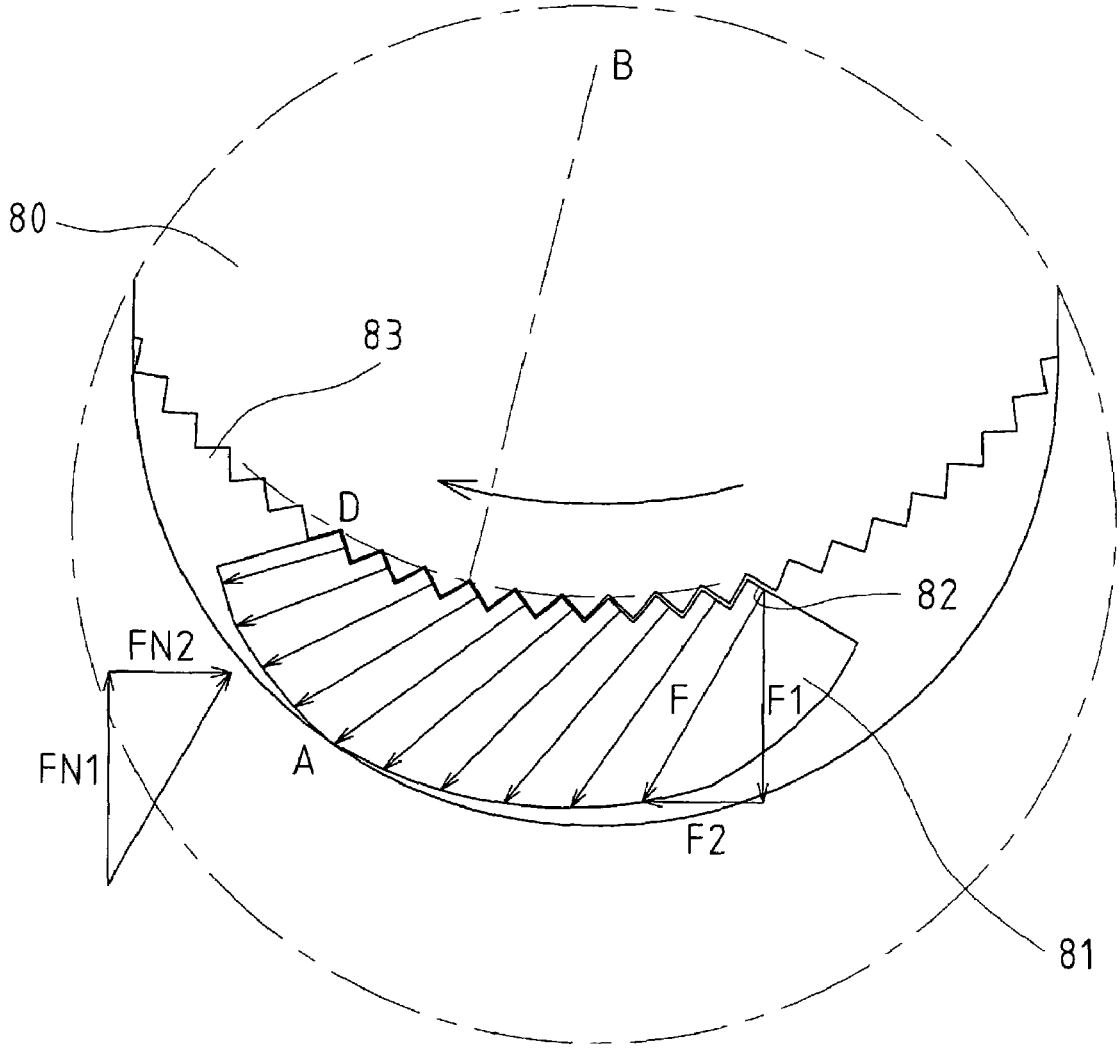
Fig. 9 PRIOR ART
FIG. 9 is a view similar to FIG. 8, wherein a handle of the conventional ratcheting tool is rotated clockwise.
Figure 10:
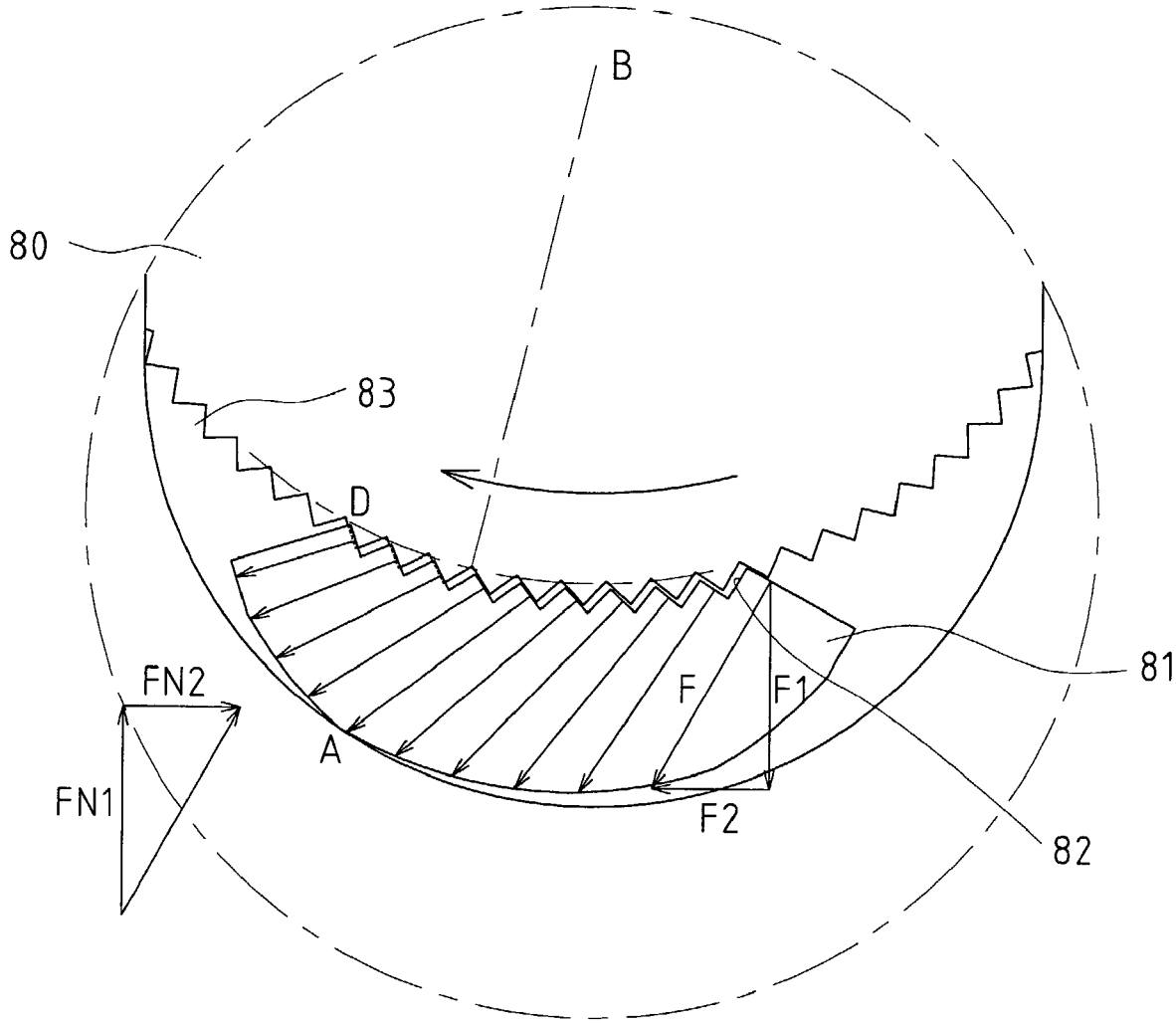
Fig. 10 PRIOR ART
FIG. 10 is a view similar to FIG. 9, wherein the handle is further rotated clockwise.

When the reversing plate 50 is in a position shown in FIG. 4, a face (upper one in FIG. 4) of the push-face 611 of the slide piece 61 bears against the pin 5211 under the action of the elastic member 62. The other side of the pawl 30 facing away from the teeth 31 bears against a wall portion defining the second compartment section 132. Thus, the teeth 31 of the pawl 30 is forced to engage with the teeth 211 of the gear wheel 21 of the drive member 20, best shown in FIG. 6. The ratcheting tool is now in a status for driving a socket (not shown) or the like clockwise. The handle of the ratcheting tool may be moved counterclockwise without disengaging the drive member 20 from the socket. Thus, the ratcheting tool may be used in a relatively small space, as the head 12 of the ratcheting tool is relatively small due to the provision of the concentric design of the gear wheel 21 and the reversing plate 50. As illustrated in FIG. 7, the through-hole 522 of the thumb piece 52 is slightly offset from the notch 42 of the ring 40. The transmission member 70 is thus in a zigzag status to provide excellent resiliency in the transverse direction for providing the required transmission.

Figure 4A:
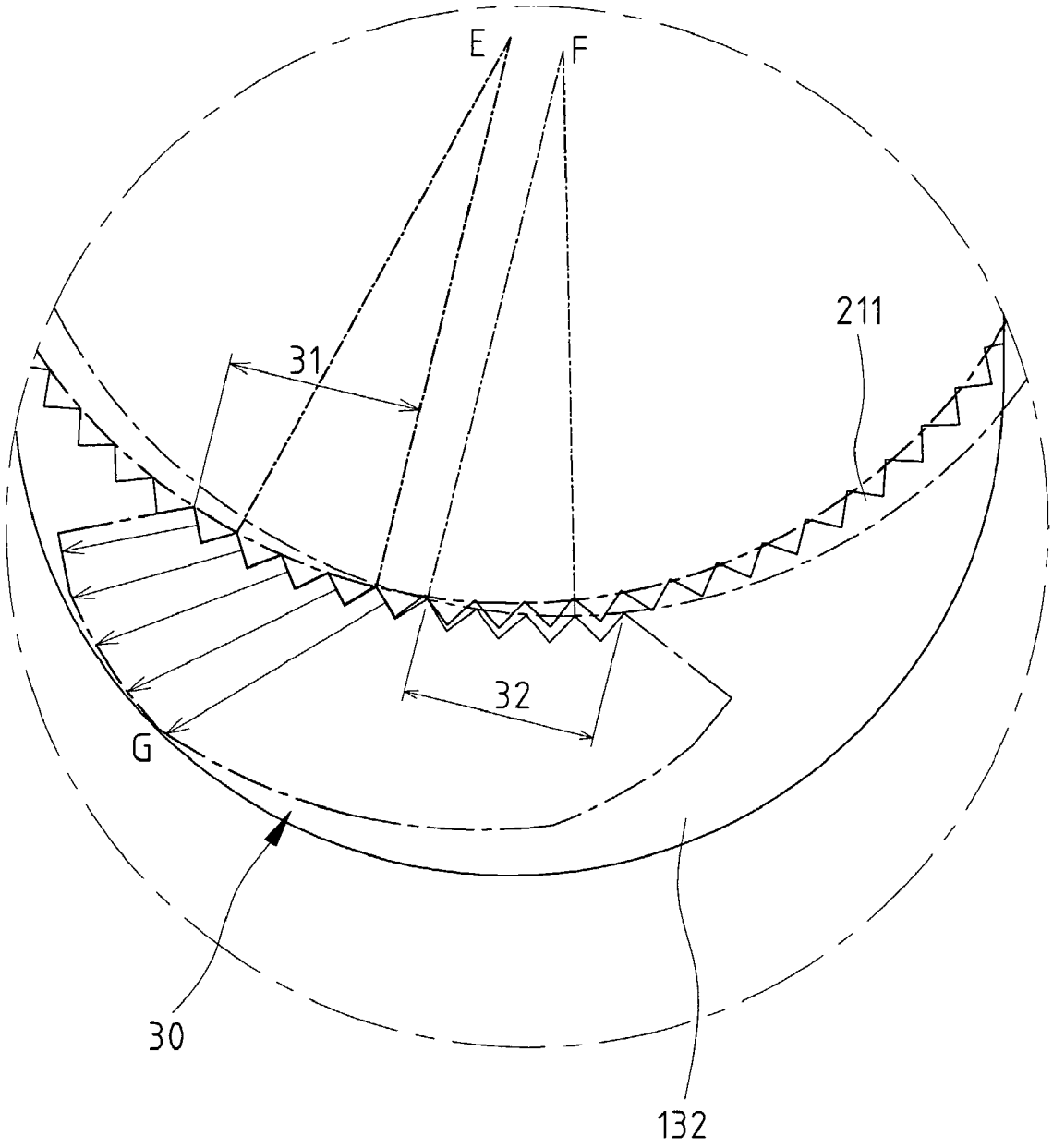
FIG. 4A is a view similar to FIG. 3A, wherein the ratcheting tool is in a status allowing clockwise ratcheting.

Referring to FIG. 4A, the pawl 30 bears against a point "G" of a left wall portion defining the second compartment section 132. It is noted that the center of curvature E of the first teeth portion 31 of the pawl 30 is coincident with a center of the gear wheel 21. Thus, all teeth of the first teeth portion 31 are completely engaged with the gear wheel teeth 211 and the second teeth portion 32 is disengaged from the gear wheel teeth 211, as the center of curvature F of the second teeth portion 32 of the pawl 30 is at a different location. When the handle 11 of the ratcheting tool 10 is rotated clockwise, no force is applied to the second teeth portion 32 of the pawl 30 and there is no reactive force accordingly. Thus, it is the first teeth portion 31 of the pawl 30 that reliably engages with the gear wheel teeth 211 during the clockwise rotation of the handle 11, thereby providing reliable high-torque operation. It is noted that force transmitted from the gear wheel 21 is uniformly distributed to all of the teeth of the first teeth portion 31. The total number of pawl teeth actually and reliably engaged with the gear wheel in accordance with the present invention is greater than that in conventional design.

Figure 3:
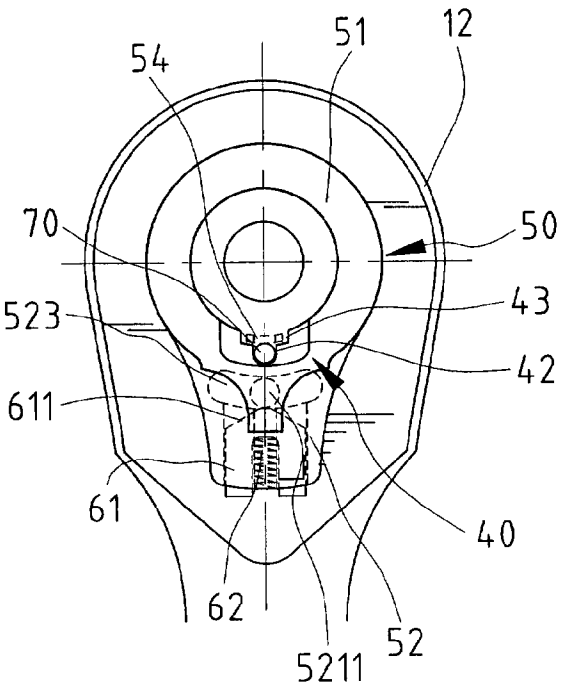
FIG. 3 is a top sectional view, in an enlarged scale, of an end portion of the reversible ratcheting tool in FIG. 1, wherein the ratcheting tool is in a status allowing free rotation.
Figure 3A:
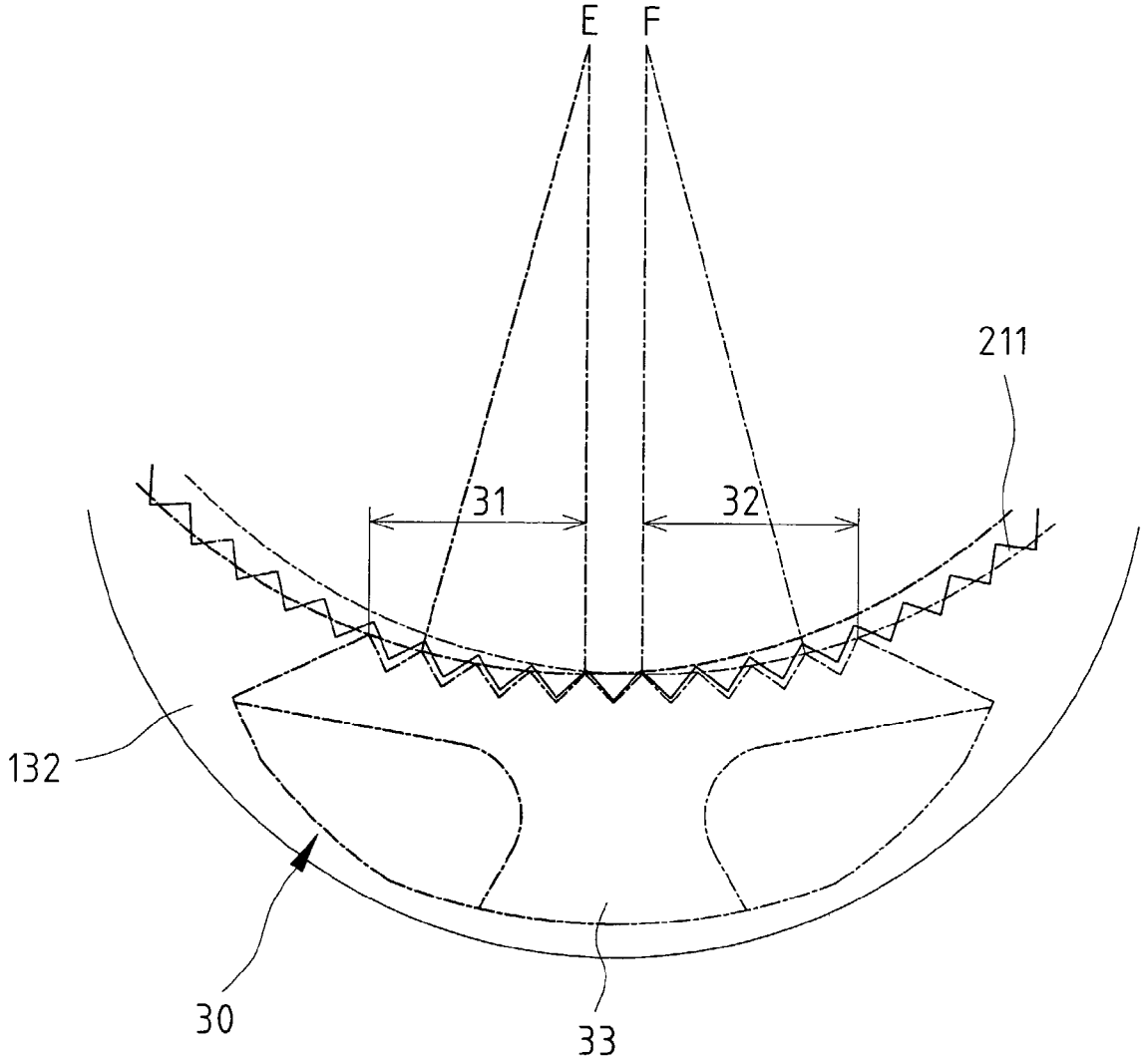
FIG. 3A is a schematic view, in an enlarged scale, illustrating engagement between a gear wheel and the pawl of the reversible ratcheting tool in accordance with the present invention, wherein the ratcheting tool is in a status allowing free rotation.

When the reversing plate 50 is moved to a position shown in FIG. 3, the tip of the push-face 611 of the slide piece 61 bears against the pin 5211 under the action of the elastic member 62. The ring 40 is also pivoted via transmission of the transmission member 70. The pawl 30 is moved away from the gear wheel 21, as the tip piece 41 of the ring 40 is engaged in the recess 33 on the top face of the pawl 30. Thus, the pawl 30 is moved to a middle portion of the second compartment section 132 and thus disengaged from the teeth 211 of the gear wheel 21. As a result, the ratcheting tool is incapable of driving the socket. Referring to FIG. 3A, only one or two of each pawl teeth portion 31, 32 are engaged with the gear wheel teeth 211, the remaining pawl teeth are disengaged from the gear wheel teeth 211.

Figure 5:
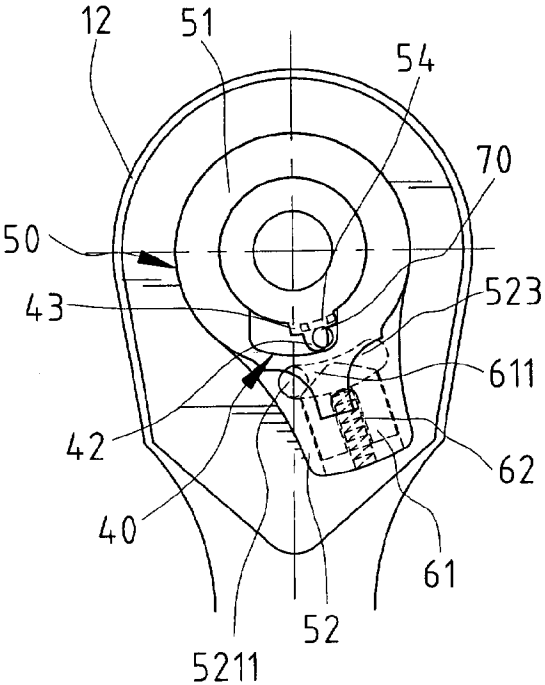
FIG. 5 is a sectional view similar to FIG. 3, wherein the reversible ratcheting tool is in a status allowing counterclockwise ratcheting.

When the reversing plate 50 is moved to a position shown in FIG. 5 by manually pushing the thumb piece 52, the slide piece 61 is moved away from the gear wheel 21 and compresses the elastic member 62. Thus, the pin 5211 may slide over the push-face 611 of the slide piece 61 to the other face of the push-face 611. The other side of the pawl 30 facing away from the teeth portions 31 and 32 bears against another portion defining the second compartment section 132. Thus, the teeth of the pawl 30 are forced to reengage with the teeth 211 of the gear wheel 21 of the drive member 20 (see FIG. 6). The ratcheting tool is now in a status for driving the socket counterclockwise. It is appreciated that the pawl 30 is pivoted during pivotal movement of the thumb piece 52 via transmission of the transmission member 70 and the ring 40 that engages with the pawl 30.

Figure 5A:
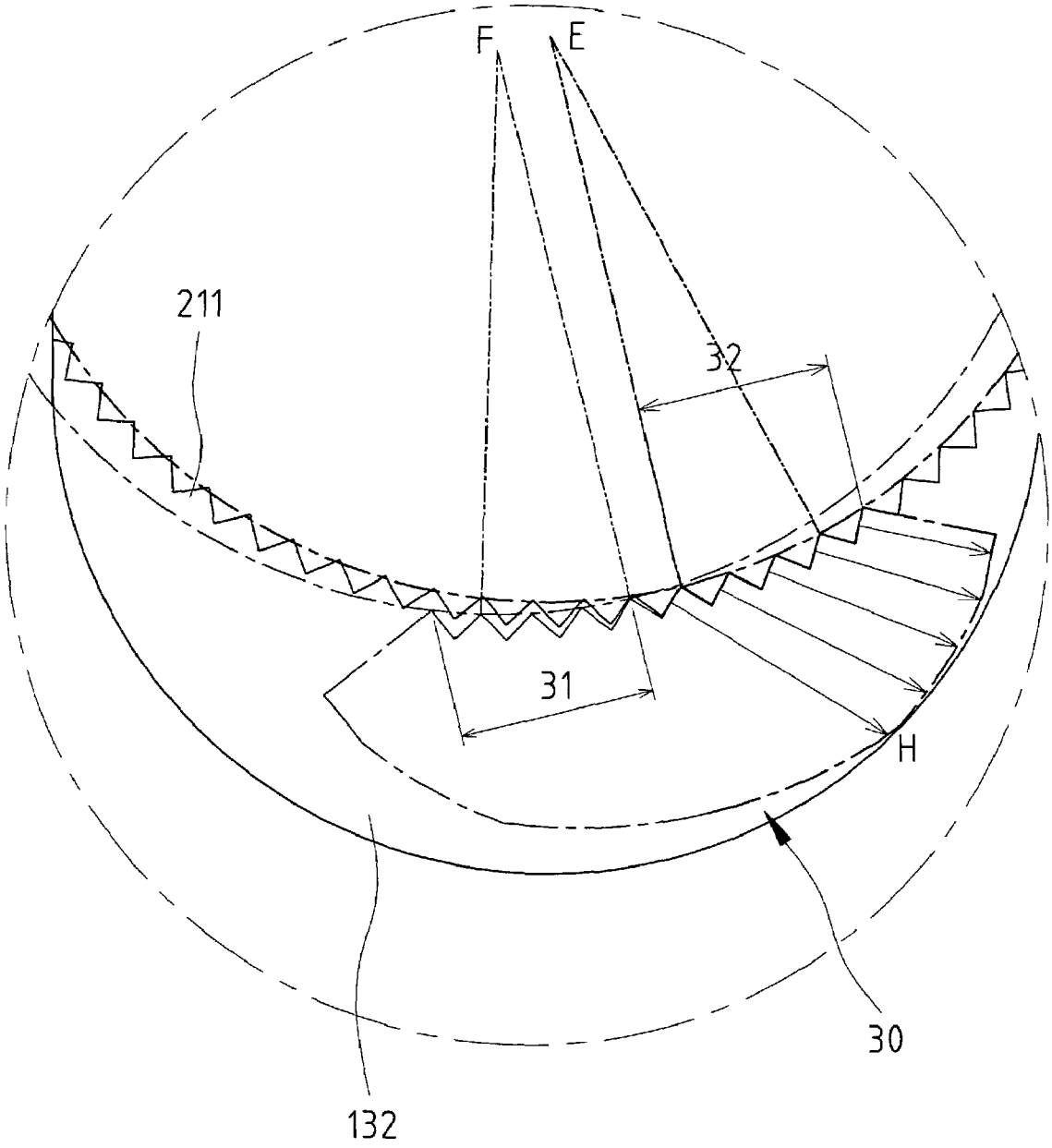
FIG. 5A is a view similar to FIG. 3A, wherein the ratcheting tool is in a status allowing counterclockwise ratcheting.

Referring to FIG. 5A, the pawl 30 bears against a point "H" of a right wall portion defining the second compartment section 132. Now the center of curvature F of the second teeth portion 32 of the pawl 30 is coincident with the center of the gear wheel 21. Thus, all teeth of the second teeth portion 32 are completely engaged with the gear wheel teeth 211 and the first teeth portion 31 is disengaged from the gear wheel teeth 211, as the center of curvature E of the first teeth portion 31 of the pawl 30 is at a different location. When the handle 11 of the ratcheting tool 10 is rotated counterclockwise, no force is applied to the first teeth portion 31 of the pawl 30 and there is no reactive force accordingly. Thus, it is the second teeth portion 32 of the pawl 30 that reliably engages with the gear wheel teeth 211 during the clockwise rotation of the handle 11, thereby providing reliable high-torque operation. It is noted that force transmitted from the gear wheel 21 is uniformly distributed to all of the teeth of the second teeth portion 32. The total number of pawl teeth actually and reliably engaged with the gear wheel in accordance with the present invention is greater than that in conventional design.

Referring to FIG. 6, it is noted that the retainer block 54 of the reversing plate 50 is in contact with a portion of the transmission member 70 to prevent disengagement and over-distortion of the transmission member 70. The lower portion 541 of the retainer block 54 is pivotally received in the enlarged section 43 of the notch 42 such that the retainer block 54 can be pivoted when the reversing plate 50 is pivoted.

It is appreciated that the pawl 30 engages with the gear wheel 21 by ten (10) teeth and thus may bear higher torque during ratcheting. It is noted that the push-face 611 of the slide piece 61, under the action of the elastic member 62, retains the ring 40 as well as the pawl 30 in place to provide reliable ratcheting. Yet, the tip piece 41 of the ring 40 and the recess 33 of the pawl 30 are configured to allow the pawl 30 to be moved away from the gear wheel 21 in a radial direction during non-driving rotation of the handle. Accordingly, the user must apply a relatively larger force to switch the reversing plate 50, yet this also prevents inadvertent impingement to the thumb piece 52 that may cause undesired movement of the pawl 30.

According to the above description, it is appreciated that the ratcheting tool in accordance with the present invention may bear much higher torque and has minimized head size that is very useful when operating in a limited space. In addition, the ratcheting direction can be changed by easy operation of the reversing plate. The arrangement for achieving the ratcheting direction switching is simple yet requires a relatively larger force to prevent inadvertent switching. Of more importance, the total number of pawl teeth actually and reliably engaged with the gear wheel in accordance with the present invention during ratcheting is greater than that in conventional design, and such advantage is the result of the novel design in the first and second teeth portions 31 and 32 of the pawl 30.

Although the invention has been explained in relation to its preferred embodiment, it is to be understood that many other possible modifications and variations can be made without departing from the spirit and scope of the invention as hereinafter claimed.

What is claimed is:

1. A reversible ratcheting wrench pawl, the pawl comprising a rigid body having a side with a plurality of teeth, said plurality of teeth including a first teeth portion having a first center of curvature and a second teeth portion having a second center of curvature located at a position different from the first center of curvature, wherein the pawl has a first ratcheting position, wherein the first teeth portion is completely engaged with a gear wheel and the second teeth portion is disengaged with the gear wheel, and a second ratcheting position wherein the second teeth portion is completely engaged with the gear wheel and the first teeth portion is disengaged with the gear wheel, wherein the pawl moves between the first ratcheting position and the second ratcheting position by rotating about an axis that does not intersect said rigid body.

2. The pawl as claimed in claim 1, with the first center of curvature having a radius and the second center of curvature having a radius equal to the radius of the first center of curvature, with the gear wheel has a radius equal to the radii of the first and second centers of curvature.

3. The pawl as claimed in claim 2, with each of the first and second teeth portions including at least five teeth.

4. The pawl as claimed in claim 3, wherein the first and second teeth portions combined include at least ten teeth.

5. The pawl as claimed in claim 4, with the first teeth portion and the second teeth portion being arranged in a continuous manner.

6. The pawl as claimed in claim 1, with each of the first and second teeth portions including at least five teeth.

7. The pawl as claimed in claim 6, wherein the first and second teeth portions combined include at least ten teeth.

8. The pawl as claimed in claim 7, with the first teeth portion and the second teeth portion being arranged in a continuous manner.

9. The pawl as claimed in claim 8, with the pawl including a face having a recess adapted to be engaged by a tip for moving the pawl between the first and second ratcheting positions.

10. The pawl as claimed in claim 9, with the pawl including an other side facing away from the plurality of teeth, with the face being a top extending between the side and the other side.

11. The pawl as claimed in claim 10, with the other side being formed to bear against a wall portion of a compartment section formed in a head extending from a handle.

12. The pawl as claimed in claim 11, with the side including first and second faces extending outwardly on opposite sides of the plurality of teeth and interconnected to the other side.

13. The pawl as claimed in claim 1, with the pawl including an other side facing away from the plurality of teeth, with the other side being formed to bear against a wall portion of a compartment section formed in a head extending from a handle, wherein the other side bears against one side of the wall portion in the first ratcheting position and bears against an opposite side of the wall portion in the second ratcheting position.

14. The pawl as claimed in claim 1, wherein the pawl includes an other side facing away from the plurality of teeth and wherein the side includes first and second faces extending outwardly on opposite sides of the plurality of teeth and being interconnected to the other side.

15. The pawl as claimed in claim 1, wherein the pawl is adapted to be installed in a wrench.

16. The pawl as claimed in claim 1, wherein the first teeth portion and the second teeth portion are adjacent.

17. The pawl as claimed in claim 1, wherein the first teeth portion and the second teeth portion are adjoining.

18. The pawl as claimed in claim 1, wherein the plurality of teeth form a substantially concave surface.

19. The pawl of claim 1 wherein the first center of curvature is fixed relative to the second center of curvature.

20. A pawl comprising:

a rigid body having a first side comprising:

a plurality of teeth including a first portion having a first center of curvature and a second portion having a second center of curvature, the first and second centers of curvature being located at different points; wherein said first portion and said second portion are disposed on the first side;

a first face located on the first side and adjoining the first portion;

a second face located on the first side and adjoining the second portion; and a second side facing substantially opposite the first side, wherein the first and second faces adjoin the second side, wherein the pawl has a first ratcheting position, wherein the first portion is completely engaged with a gear wheel and the second portion is disengaged with the gear wheel, and a second ratcheting position wherein the second portion is completely engaged with the gear wheel and the first portion is disengaged with the gear wheel, wherein the pawl moves between the first ratcheting position and the second ratcheting position by rotating about an axis that does not intersect said rigid body.

21. The pawl of claim 20, wherein the first portion and the second portion are adjacent.

22. The pawl of claim 20, wherein the first portion and the second portion are adjoining.

23. The pawl of claim 20, wherein the first portion is substantially concave and the second portion is substantially concave.

24. The pawl of claim 20, wherein the pawl is adapted to at least partially mesh with the gear wheel in a wrench.

25. The pawl of claim 20 wherein the first center of curvature is fixed relative to the second center of curvature.

26. A pawl for use in a reversible ratcheting hand tool, comprising:

a rigid body having a first side and a second side;

the first side comprising a plurality of teeth, a first face, and a second face;

the body further comprising a second side facing away from the first side, wherein the first and second faces adjoin the second side; and wherein the plurality of the teeth comprise a first teeth portion having a first center of curvature and a second teeth portion having a second center of curvature located at a position different from the first center of curvature, wherein the pawl has a first ratcheting position, wherein the first teeth portion is completely engaged with a gear wheel and the second portion is disengaged with the gear wheel, and a second ratcheting position wherein the second teeth portion is completely engaged with the gear wheel and the first teeth portion is disengaged with the gear wheel wherein the pawl moves between the first ratcheting position and the second ratcheting position about an axis that does not intersect said rigid body.

27. The pawl of claim 26, wherein the first face adjoins the first teeth portion and wherein the second face adjoins the second teeth portion.

28. The pawl of claim 26, wherein the first teeth portion is adjacent to the second teeth portion.

29. The pawl of claim 26, wherein the plurality of teeth form a substantially concave surface.

30. The pawl of claim 26, wherein the first teeth portion is concave and wherein the second teeth portion is concave.

31. The pawl of claim 26, wherein the pawl is adapted to engage the gear wheel in a reversible ratcheting wrench.

32. The pawl of claim 26 , wherein the second side includes at least one recess.

33. The pawl of claim 26 wherein the position of the first center of curvature is fixed relative to the position of the second center of curvature.

34. A pawl for use in a reversible ratcheting hand tool, comprising:

a concave first teeth portion having a first center of curvature;

a concave second teeth portion having a second center of curvature, the first center of curvature being located at a different point than the second center of curvature;

wherein said first teeth portion and said second teeth portion are located on one side of a rigid pawl body, wherein the pawl has a first ratcheting position, wherein the first teeth portion is completely engaged with a with the gear wheel and the second teeth portion is disengaged with the gear wheel, and a second ratcheting position wherein the second teeth portion is completely engaged wherein the pawl moves between the first ratcheting position and the second ratcheting position by rotating about an axis that does not intersect said rigid body.

35. The pawl of claim 34, wherein the first teeth portion and the second teeth portion are continuous.

36. The pawl of claim 34, wherein the first teeth portion and the second teeth portion pivot about the outer periphery of a gear wheel.

37. The pawl of claim 34, further comprising a first side and a second side, the second side facing substantially opposite the first side, wherein the first teeth portion and the second teeth portion are disposed on the first side.

38. The pawl of claim 37, wherein the first side further includes a first face spaced from a second face by the first teeth portion and by the second teeth portion.

39. The pawl of claim 38, wherein the first face abuts the second side and wherein the second face abuts the second side.

40. The pawl of claim 38, wherein the first face and the second face are each planar.

41. The pawl of claim 38, wherein the first face extends from the first teeth portion to the second side and wherein the second face extends from the second teeth portion to the second side.

42. The pawl of claim 34 wherein the first center of curvature is fixed relative to the second center of curvature.

43. A pawl for use in a reversible ratcheting hand tool, the pawl comprising:

a unitary pawl body sized to fit within a compartment disposed within a reversible ratcheting hand tool;

a first teeth portion disposed on a first side of said unitary pawl body and having a first center of curvature;

a second teeth portion disposed on the first side of said unitary pawl body and having a second center of curvature; wherein the first and second centers of curvature are located at different positions, wherein the pawl has a first ratcheting position, wherein the first teeth portion is completely engaged with a gear wheel and the second teeth portion is disengaged with the gear wheel, and a second ratcheting position wherein the second teeth portion is completely engaged with the gear wheel and the first teeth portion is disengaged with the gear wheel, wherein the pawl moves between the first ratcheting position and the second ratcheting position by rotating about an axis that does not intersect said rigid body.

44. The pawl of claim 43 further comprising a recess disposed within a second side of said unitary pawl body, wherein the first side of said unitary pawl body is adjacent to the second side.

45. The pawl of claim 44 wherein the first side is concave and the second side is convex.

46. The pawl of claim 43 wherein the first and second teeth portions are continuous.

47. The pawl of claim 43 wherein the first center of curvature is fixed relative to the second center of curvature.

* * * * *